US007080489B2

(12) United States Patent
Jedrzejewski

(10) Patent No.: US 7,080,489 B2
(45) Date of Patent: Jul. 25, 2006

(54) SHANTY AND A SYSTEM AND A METHOD FOR ASSEMBLING THE SAME

(75) Inventor: Richard Jedrzejewski, Riverside, IL (US)

(73) Assignee: Metal Design Group, Inc., Riverside, IL (US)

( * ) Notice: Subject to any disclaimer, the term of this patent is extended or adjusted under 35 U.S.C. 154(b) by 120 days.

(21) Appl. No.: 10/612,774

(22) Filed: Jul. 2, 2003

(65) Prior Publication Data

US 2005/0000169 A1 Jan. 6, 2005

(51) Int. Cl.
*E04B 1/00* (2006.01)

(52) U.S. Cl. ..... 52/272; 52/81.5; 52/582.1

(58) Field of Classification Search ..... 52/79.1, 52/79.5, 79.9, 106, 270, 284.1, 582.1, 653.1, 52/787.1, 792.1, 795.1, 585.1, 81.4, 272, 52/283; 70/54–56, 2

See application file for complete search history.

(56) References Cited

U.S. PATENT DOCUMENTS

| | | | | | |
|---|---|---|---|---|---|
| 1,780,269 | A * | 11/1930 | Miller | ..... | 52/578 |
| 2,023,814 | A * | 12/1935 | Lindsey | ..... | 52/91.3 |
| 3,670,466 | A * | 6/1972 | Lynch | ..... | 52/211 |
| 3,734,552 | A * | 5/1973 | Haxton | ..... | 292/67 |
| 3,820,295 | A * | 6/1974 | Folley | ..... | 52/270 |
| 4,068,421 | A * | 1/1978 | Marovich | ..... | 52/81.4 |
| 4,592,175 | A * | 6/1986 | Werner | ..... | 52/79.9 |
| 5,813,174 | A * | 9/1998 | Waller | ..... | 52/79.1 |
| 6,286,269 | B1 * | 9/2001 | Marcum | ..... | 52/79.5 |
| 6,415,557 | B1 * | 7/2002 | McCalley | ..... | 52/79.1 |
| 6,415,558 | B1 * | 7/2002 | Cherry | ..... | 52/79.1 |
| 6,581,337 | B1 * | 6/2003 | Skov et al. | ..... | 52/79.5 |
| 6,786,009 | B1 * | 9/2004 | McGunn et al. | ..... | 52/36.2 |
| 2003/0066249 | A1 * | 4/2003 | Walsh | ..... | 52/79.1 |

FOREIGN PATENT DOCUMENTS

| | | | | | |
|---|---|---|---|---|---|
| JP | 405033510 | A * | 7/1991 | ..... | 52/272 |
| JP | 2002146913 | A * | 5/2002 | | |

* cited by examiner

*Primary Examiner*—Naoko Slack
(74) *Attorney, Agent, or Firm*—Patents & TMS, P.C.

(57) ABSTRACT

A shanty and a system and method for assembling the same are provided. The shanty may be assembled, disassembled and re-assembled using the same components of the shanty. The shanty may have panels which may be removably fastened to each other to assemble the shanty. A first type of panel may be a wall panel. A second type of panel, namely, a roof panel, may be attached to the wall panel to provide a ceiling for the shanty. The panels may be substantially planar in shape. Moreover, the panels may have a length defined between a first end and a second end wherein a section of each of the panels at the first end extends toward the second end. To assemble the shanty, the section of a first panel which extends toward the second end may be fastened to the section of a second panel which extends toward the second end.

19 Claims, 7 Drawing Sheets

SHANTY AND A SYSTEM AND A METHOD FOR ASSEMBLING THE SAME

BACKGROUND OF THE INVENTION

The present invention generally relates to a shanty and a system and a method for assembling the same. More specifically, the present invention relates to a shanty which may be assembled, disassembled and re-assembled by an individual. The shanty may have panels which may provide a roof and walls. The panels may be removably attached and/or fastened to assemble the shanty.

It is generally known when constructing a building, or like structure, to erect a shanty at the construction site. The shanty may have walls, a door and a ceiling and may be in the shape of a room or the like. The shanty may be used, for example, as a meeting place for workers. The shanty may also be used to store a worker's personal items and/or as a changing room. In addition, the shanty may be used to store items such as, for example, drawings, tools, equipment, or other construction-related items.

A typical shanty is constructed from wood or the like. In some cases, the wood may be fire-rated. Known shanties may have different sizes and shapes depending on, for example, a number of workers associated with a construction project, or an amount and/or type of space provided at a construction site for the shanty. A larger-sized shanty may require a greater amount of wood and/or other components, such as, for example, fasteners, fixtures, or other building components. To create the walls, ceiling, door, or other parts of a shanty, the wood must be fastened together. Construction of a shanty, in some cases, may require up to, for example, thirty or more hours of labor. Thus, construction of a shanty can be a tedious, time-consuming, and labor-intensive task. In addition, the wood, as well as the other materials used to build the shanty, and/or the labor may be expensive, adding to the costs associated with, for example, the construction project.

After completion of a construction project, the shanty is often discarded. Thus, a construction crew, for example, undertaking different construction projects must erect a new shanty for each project. New materials to construct the shanty must also be acquired.

A need, therefore, exists for a shanty and a system and a method for assembling the same wherein the shanty may be assembled, disassembled and re-assembled using the same components.

SUMMARY OF THE INVENTION

The present invention generally relates to a shanty which may be assembled, disassembled and re-assembled using the same components. The shanty may have a plurality of panels which may be removably fastened to each other to assemble the shanty. A first type of panel may be a wall panel. One or more wall panels may be used to provide walls and a door for the shanty. A second type of panel, namely, a roof panel, may be attached to the wall panel to provide a ceiling for the shanty. The panels may be substantially planar in shape. Moreover, the panels may have a length defined between a first end and a second end wherein a section of each of the panels at the second end is positioned toward the first end in a folded-like manner. The folded section of a first panel may be fastened to the folded section of a second panel to assemble the shanty.

To this end, in an embodiment of the present invention, a shanty is provided. The shanty has a plurality of walls defining a room having an interior wherein each of the walls has a length defined between a first end and a second end and a width defined between a third end and a fourth end wherein a section of each of the walls at the first end extends into the interior of the room. The shanty also has a plurality of roof panels defining a ceiling for the room wherein each of the roof panels has a length defined between a first end and a second end and a width defined between a third end and a fourth end wherein a section of each of the roof panels at the first end extends into the interior of the room and further wherein the section of one of the walls extending into the interior is attached to the section of one of the roof panels extending into the interior wherein the plurality of walls and the plurality of roof panels attach to define the room.

In an embodiment, the shanty has a fastener attaching the wall to the roof panel.

In an embodiment, the length of one of the roof panels is equal to twice the width of one of the walls.

In an embodiment, the shanty has a post attached to one of the plurality of roof panels.

In an embodiment, the shanty has a brace attached to one of the plurality of walls and one of the plurality of roof panels.

In an embodiment, a section of each of the plurality of walls at the third end is folded into the interior of the room.

In an embodiment, the shanty has a hole formed within the section of the wall extending into the interior of the room.

In an embodiment, the shanty has a slot formed within the section of the roof panel extending into the interior of the room.

In an embodiment, the walls are constructed from metal.

In another embodiment of the present invention, a system is provided. The system has a plurality of wall panels defining a room wherein each of the wall panels has a length defined between a first end and a second end and wherein a section of each of the wall panels at the first end extends toward the second end of the wall panel. The system also has a roof panel contacting the plurality of wall panels at the first end to provide a ceiling for the room wherein the roof panel has a length defined between a first end and a second end wherein a section of the roof panel at the first end extends toward the second end of the roof panel. Further, the system has a fastener attaching one of the wall panels to the roof panel wherein the section of the wall panel extending toward the second end of the wall panel is attached to the section of the roof panel extending toward the second end of the roof panel.

In an embodiment, the system has a post attached the roof panel.

In an embodiment, the system has a slot formed within the section of the wall panel.

In an embodiment, the system has a slot formed within the section of the roof panel.

In an embodiment, the roof panel is defined by a plurality of removably attached sections.

In an embodiment, the system has a door positioned adjacent to one of the wall panels.

In an embodiment, the system has a handle attached to one of the wall panels.

In an embodiment, the system has a hinge attached to one of the wall panels.

In an embodiment, the system has a brace attached to one of the plurality of wall panels and the roof panel.

In another embodiment of the present invention, a method is provided for assembling a shanty having an interior. The method comprises the steps of: providing a plurality of walls defining a room having an interior wherein each of the walls has a length defined between a first end and a second end wherein a section of each of the walls at the first end extends into the interior of the room; providing a roof panel defining a ceiling for the room wherein the roof panel has a length defined between a first end and a second end wherein a section of the roof panel at the first end extends into the interior of the room; and fastening one of the plurality of wall panels to one of the plurality of roof panels.

In an embodiment, the method further has the step of attaching a post to the roof panel.

In an embodiment, the method further has the step of attaching a hinge to one of the plurality of wall panels.

It is, therefore, an advantage of the present invention to provide a shanty and a system and a method for assembling the same wherein the shanty may be assembled, disassembled and re-assembled.

Another advantage of the present invention is to provide a shanty and a system and method for assembling the same wherein the shanty is inexpensive to manufacture.

A still further advantage of the present invention is to provide a shanty and a system and method for assembling the same wherein the shanty is easy to assemble.

Yet another advantage of the present invention is to provide a shanty and a system and method for assembling the same which may reduce an amount of time required to assemble a shanty.

Another advantage of the present invention is to provide a shanty and a system and method for assembling the same which prevents discarding of materials used to construct the shanty.

A further advantage of the present invention is to provide a shanty and a system and method for assembling the same wherein one or more dimensions of the shanty may be adjusted.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a shanty and a system and method for assembling the same. The shanty may have panels which may be removably fastened to each other to assemble, disassemble and re-assemble the shanty. Each of the panels may have a length defined between a first end and a second end. A section of a panel at a first end may be folded or positioned toward the second end. The folded section of a first panel may be removably fastened to a folded section of a second panel.

Figure 1:
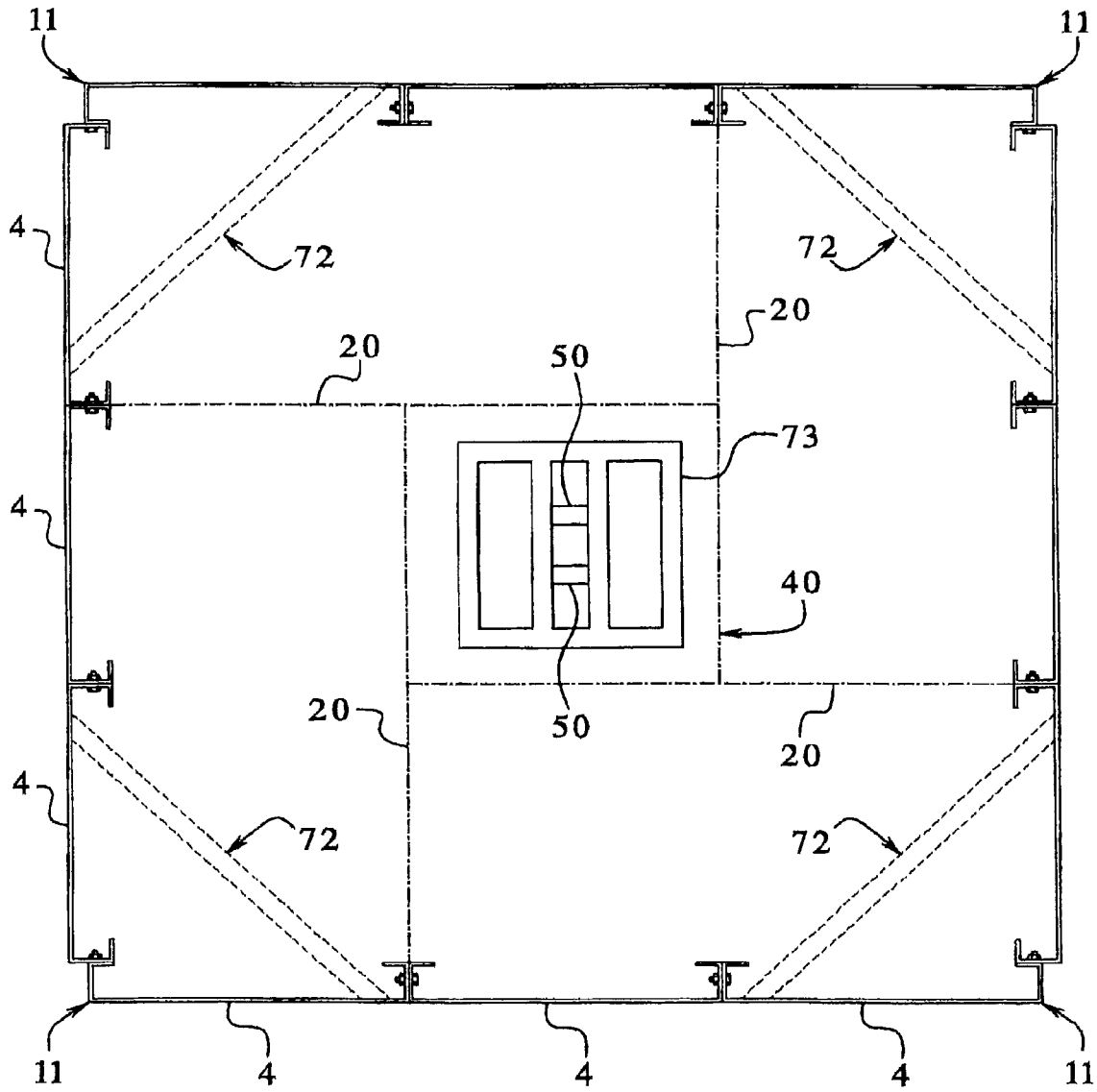
FIG. 1 illustrates a top plan view of a shanty in an embodiment of the present invention.
Figure 2A:
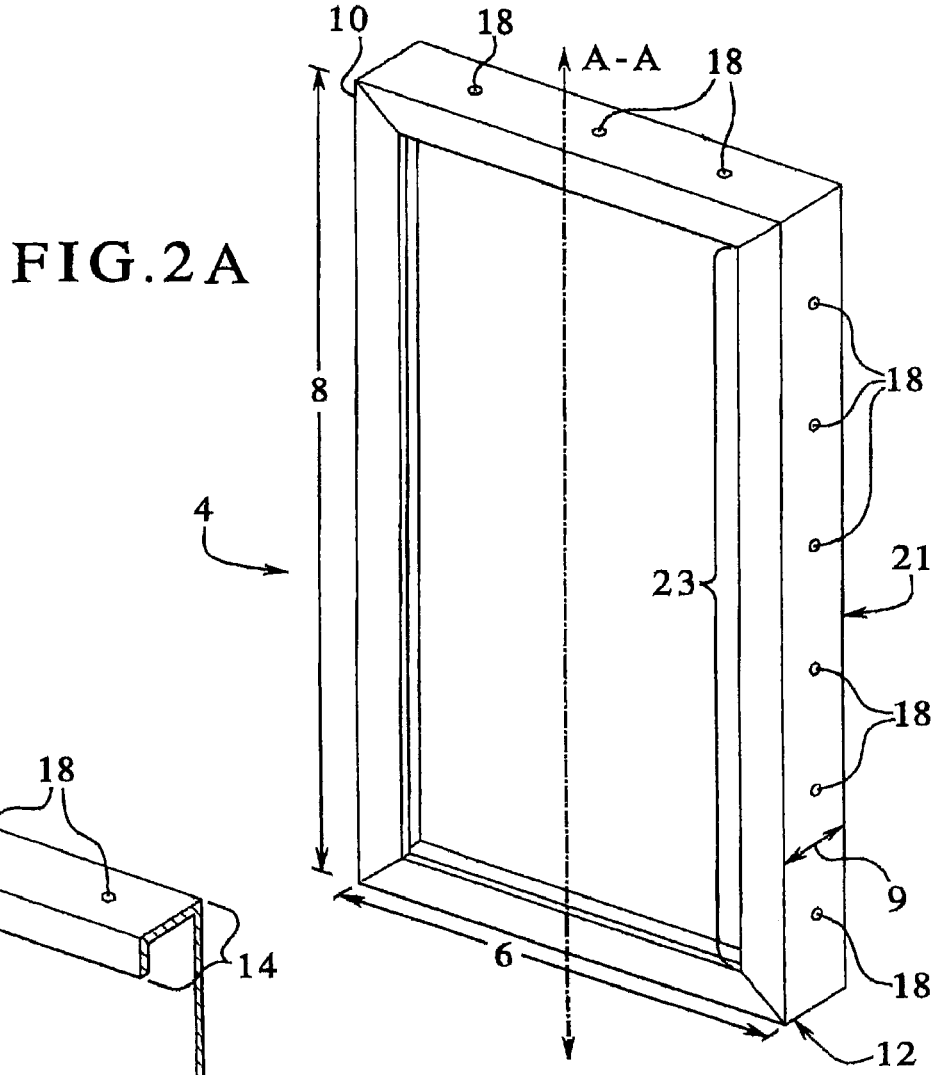
FIG. 2A is a perspective view of a wall panel of a shanty in an embodiment of the present invention.
Figure 2B:
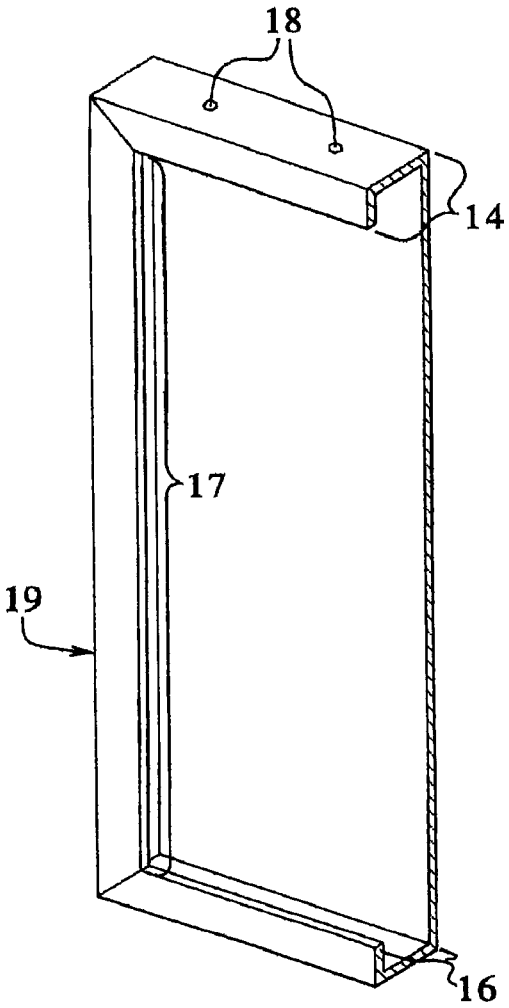
FIG. 2B is a cross-sectional view of the wall panel taken generally along the line A—A of FIG. 2A.

Referring now to the figures wherein like numerals refer to like parts, FIG. 1 illustrates an overhead view of a shanty 2 in an embodiment of the present invention. The shanty 2 may have a plurality of panels (described in further detail below.) A first type of panel, or wall panel 4, is illustrated in FIGS. 2A and 2B. The wall panel 4 may be constructed from, for example, a metal, such as, aluminum, steel, or the like. In an embodiment, the wall panel 4 may be constructed from, for example, fiberglass, plastic, or like material. In a preferred embodiment, the wall panel 4 is constructed from aluminum. The wall panel 4 may have a width 6 and a length 8 defined between a first end 10 and a second end 12. The length 8 may be sized to accommodate a height of individuals using the shanty 2 when constructed. The wall panel 4 may be substantially planar in shape and may have a depth 9.

FIG. 2B illustrates a cross-sectional view of the wall panel 4 taken generally along the line A—A. A section 14 of the wall panel 4 at the first end 10 may extend from the first end 10 and may be positioned toward the second end 12 of the wall panel 4. In an embodiment, the section 14 is integrally formed with the wall panel 4. In another embodiment, the section 14 may be attached to the wall panel 4. Likewise, a section 16 of the wall panel 4 at the second end 12 may extend from the second end 12 and may be positioned toward the first end 10. The section 16 may be integrally formed with the wall panel 4 or may be attached to the wall panel 4. A section 17 may extend from a side 19 and may be positioned toward a side 21. Likewise, a section 23 may extend from the side 21 and be positioned toward the side 19. Holes 18 may be provided within the sections 14, 16, 17 and 23. The holes 18 may be sized to receive various fasteners (described in further detail below).

Figure 3A:
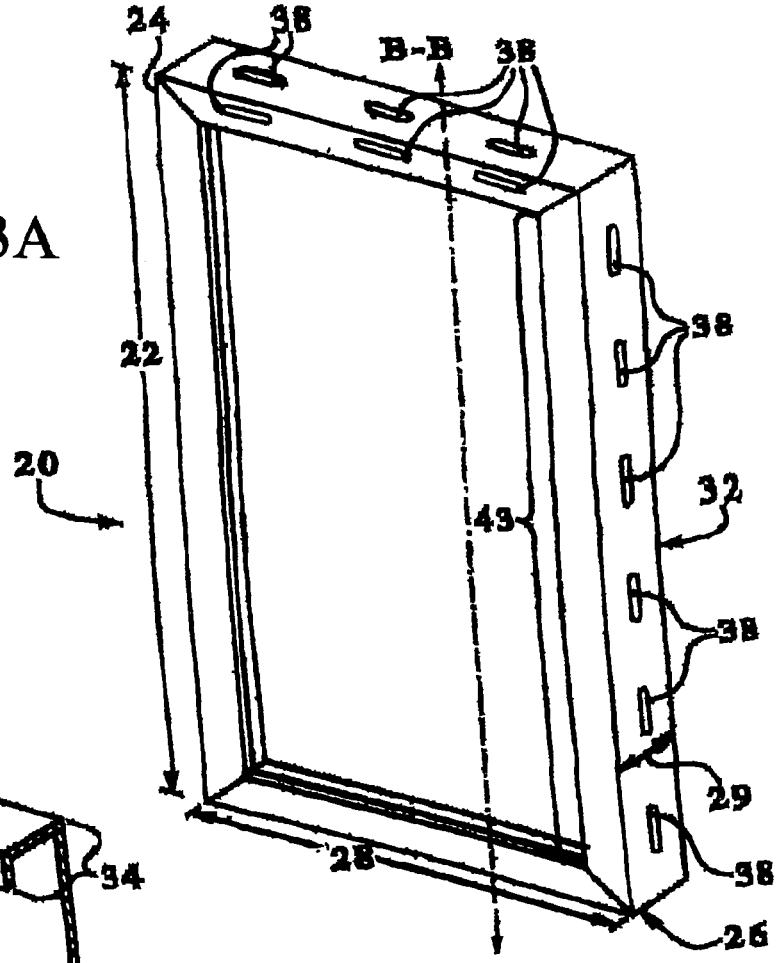
FIG. 3A illustrates a perspective view of a roof panel in an embodiment of the present invention.
Figure 3B:
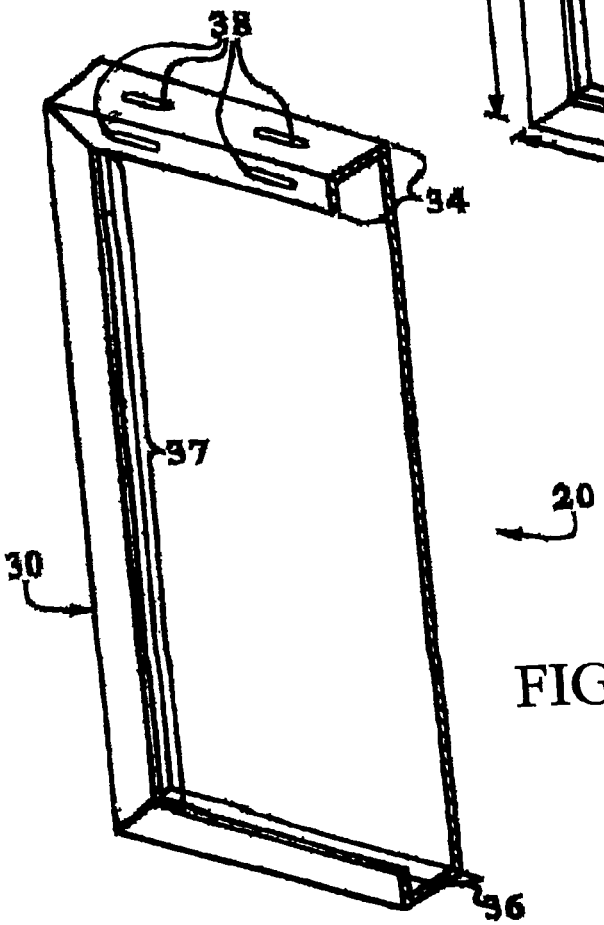
FIG. 3B illustrates a cross-sectional view of the roof panel taken generally along the line B—B of FIG. 3B.

FIGS. 3A and 3B illustrate a roof panel 20 for the shanty 2. The roof panel 20 may be constructed from a metal, such as, for example, aluminum, steel, or the like and may be substantially planar in shape. In an embodiment, the roof panel 20 may be constructed from, for example, fiberglass, plastic, or like material. The roof panel 20 may have a length 22 defined between a first end 24 and a second end 26. The roof panel 20 may also have a width 28 defined between a first side 30 and a second side 32. Further, the roof panel 20 may have a depth 29. In the embodiment illustrated in FIG. 1, the length 22 of the roof panel 20 may be twice as great as the width 6 of the wall panel 4. In other embodiments, the length 22 of the roof panel 20 may be sized as appropriate based on the width 6 of the wall panel 4. Moreover, the roof panel 20 may have any length 22 or a width 28 to define a size or a shape for the shanty 2.

FIG. 3B illustrates a cross-sectional view of the roof panel 20 taken generally along the line B—B. A section 34 of the roof panel 20 at the first end 24 may extend from the first end 24 and may be positioned toward the second end 26 of the roof panel 20. In an embodiment, the section 34 is integrally formed with the roof panel 4. A section 36 of the roof panel 20 at the second end 26 may extend from the second end 26 and may be positioned toward the first end 24. The section 36 may be integrally formed with the roof panel 4 or may be attached to the roof panel 20. A section 37 may extend from the side 30 and may be positioned toward the side 32.

Likewise, a section 43 may extend from the side 32 and may be positioned toward the side 30. Slots 38 may be provided within the section 34 and/or the section 36. The slots 38 may be sized to receive the various fasteners described below.

Figure 4:
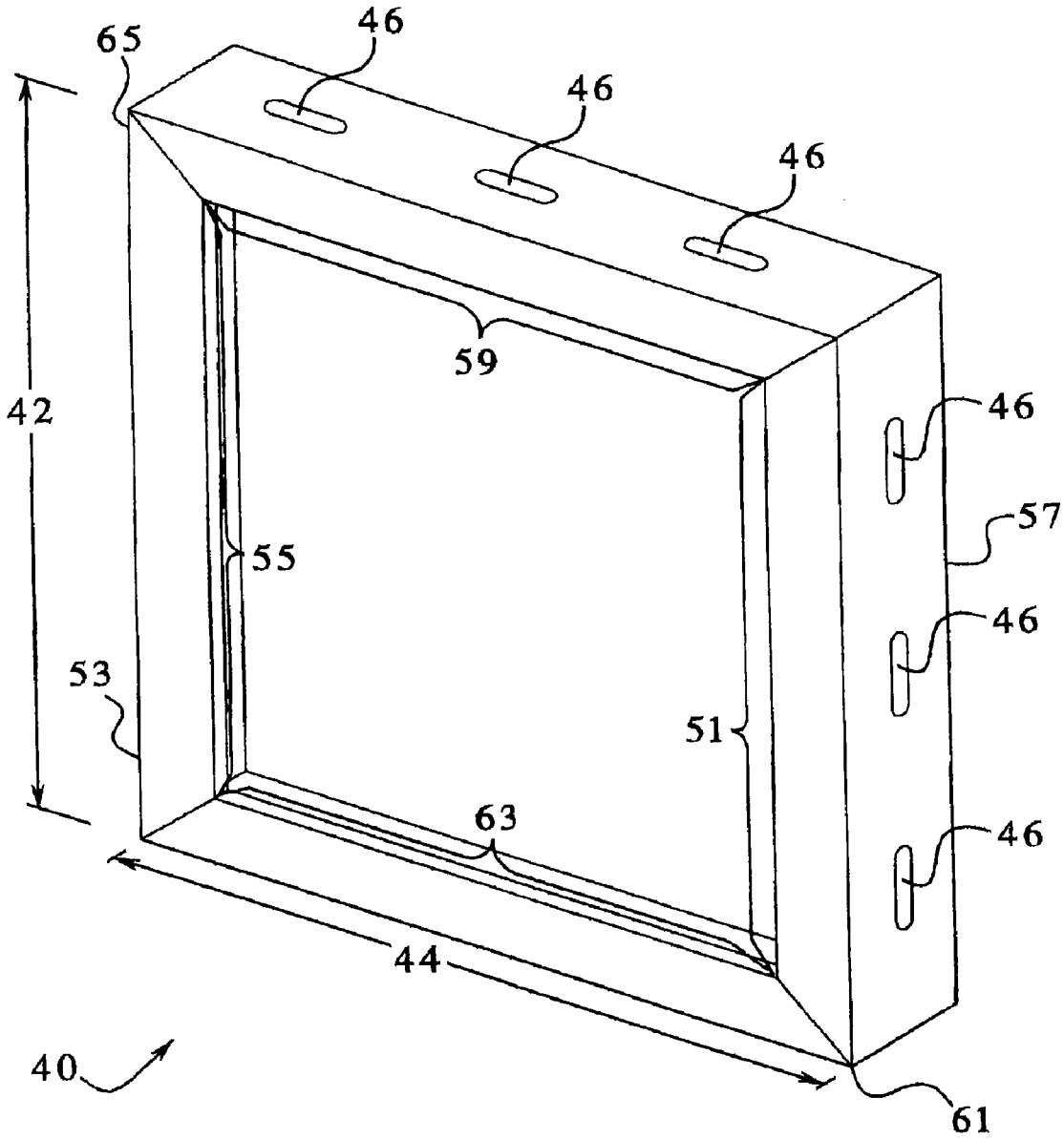
FIG. 4 illustrates a perspective view of a roof panel in an embodiment of the present invention.

FIG. 4 illustrates a center roof panel 40 which may attach to one or more roof panels 20. The center roof panel 40 may have a length 42 and a width 44. In an embodiment, the length 42 may be equal to the width 44. In an embodiment, the length 42 of the center roof panel 40 may be approximately one-half of the length 22 of the roof panel 20. However, in other embodiments, the center roof panel 40 may have any length 42 or width 44 based on a desired size and/or shape of the shanty 2. The center roof panel 40 may have a section 51 which may extend toward a side 53. A section 55 may extend toward a side 57. The center roof panel 40 may also have a section 59 which may extend toward an end 61. Further, a section 63 may extend toward an end 65. The center roof panel 40 may have slots 46 to enable fastening of the center roof panel 40 to one or more roof panels 20 by, for example, screws, bolts, or the like.

As illustrated in FIG. 1, the center roof panel 40 is surrounded by adjacent roof panels 20. The center roof panel 40 may be supported by a frame 73. A post 50 within the shanty 2 may be connected to the frame 73 and may provide support to the frame 73. The post 50 may extend from the frame 73 to, for example, a floor or ground. The frame 73 may have a section (not shown) which may be shaped to receive the post 50. In an embodiment, the frame 73 and/or the post 50 are rectangular in shape.

Figure 5:
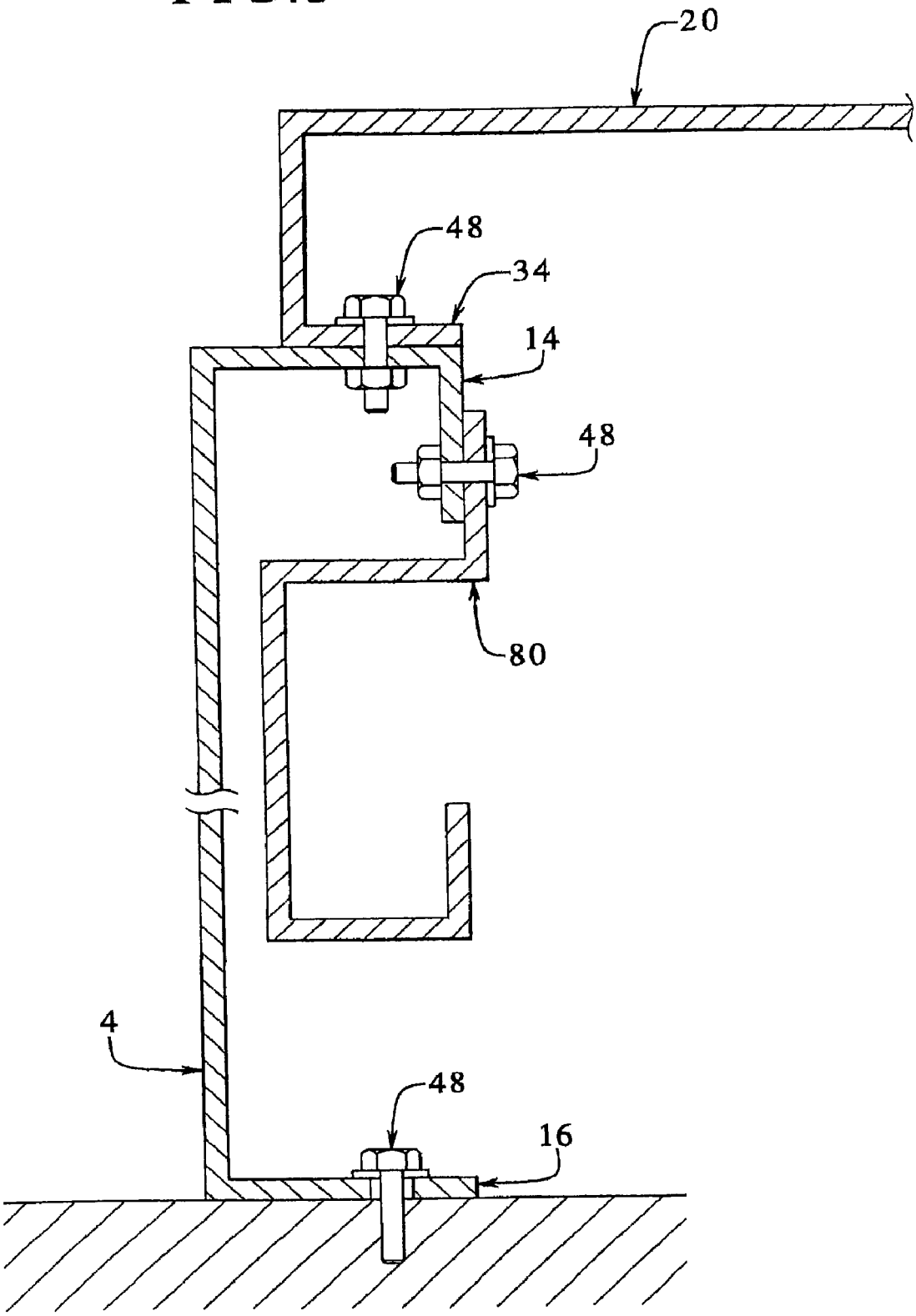
FIG. 5 illustrates a side view of a connection between a wall panel and a roof panel in an embodiment of the present invention.

Referring now to FIG. 5, a side view is provided of the wall panel 4 attached to the roof panel 20. More specifically, the section 14 of the wall panel 4 is fastened to the section 34 of the roof panel 20. A fastener 48, such as, for example, a nut and a bolt, may be inserted into one of the holes 18 of the wall panel 4 as well as one of the slots 38 of the roof panel 20. The section 16 of the wall panel 4 may be fastened to, for example, the floor, the ground, or other surface. FIG. 5 also illustrates a shelf 80 which may be attached to the section 14 of the wall panel 4.

Figure 6:
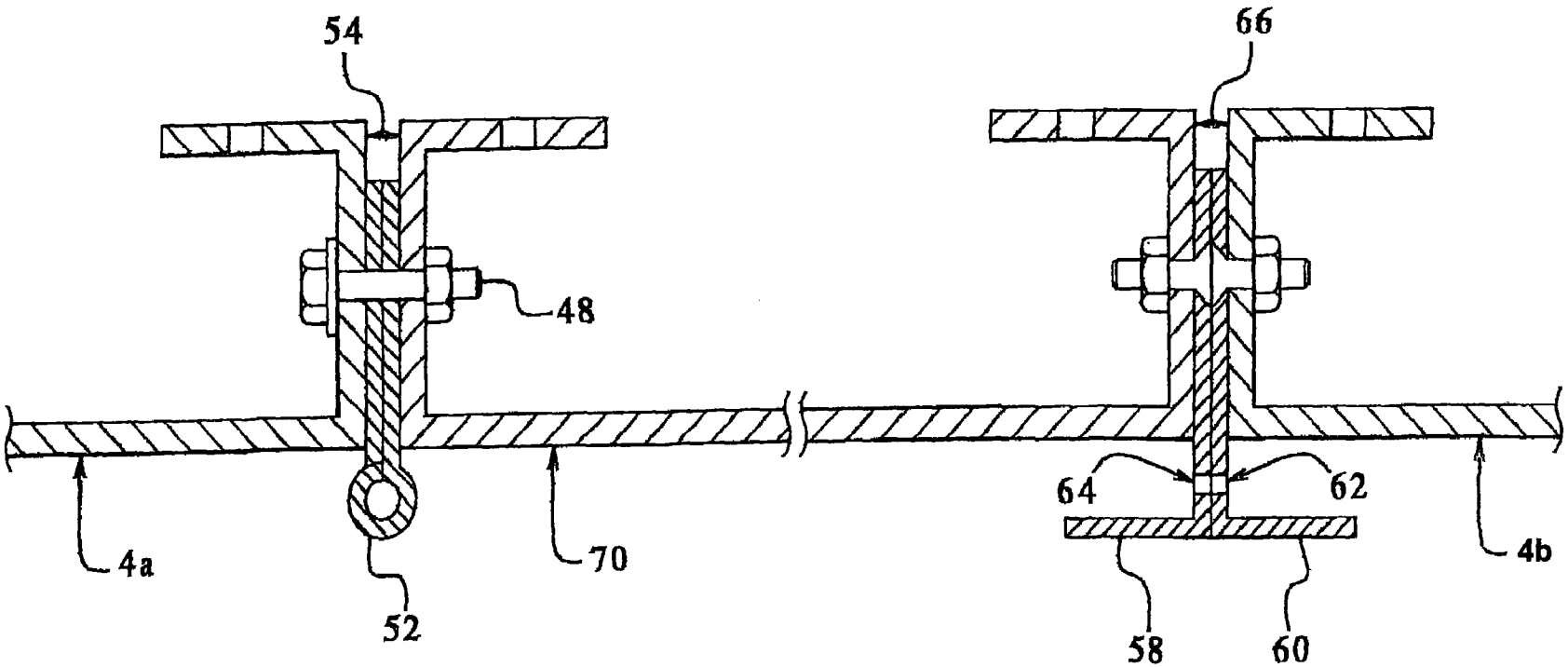
FIG. 6 illustrates a top plan view of a door of a shanty in an embodiment of the present invention.

FIG. 6 illustrates a top plan view of wall panels 4*a* and 4*b* which may be adjacent to a door 70. In an embodiment, the door 70 may have a shape similar to a wall panel 4. A hinge 52 may be positioned between the wall panel 4*a* and the door 70. The hinge 52 may be, for example, a continuous hinge and may contact the wall panel 4*a* and the door 70 along the length of the wall panel 4*a* and the door 70. A space 54 may exist between the wall panel 4*a* and the door 70 to enable insertion of the hinge 52. In addition, a handle 58 may be attached to the door 70. The handle 58 may enable an individual to open or close the door 70. A second handle 60 may be attached to the wall panel 4*b*. The second handle 60 may have an aperture 62, and the handle 58 may have an aperture 64 wherein the apertures 62, 64 are aligned. As a result, an individual may insert a locking mechanism (not shown) into the apertures 62, 64 to lock the door 70 to the wall panel 4*b* and prevent access into the shanty 2. A space 66 may exist between the door 70 and the wall panel 4*b* to enable the handle 58 and the second handle 60 to attach to the door 70 and the wall panel 4*b*, respectively.

Figure 7:
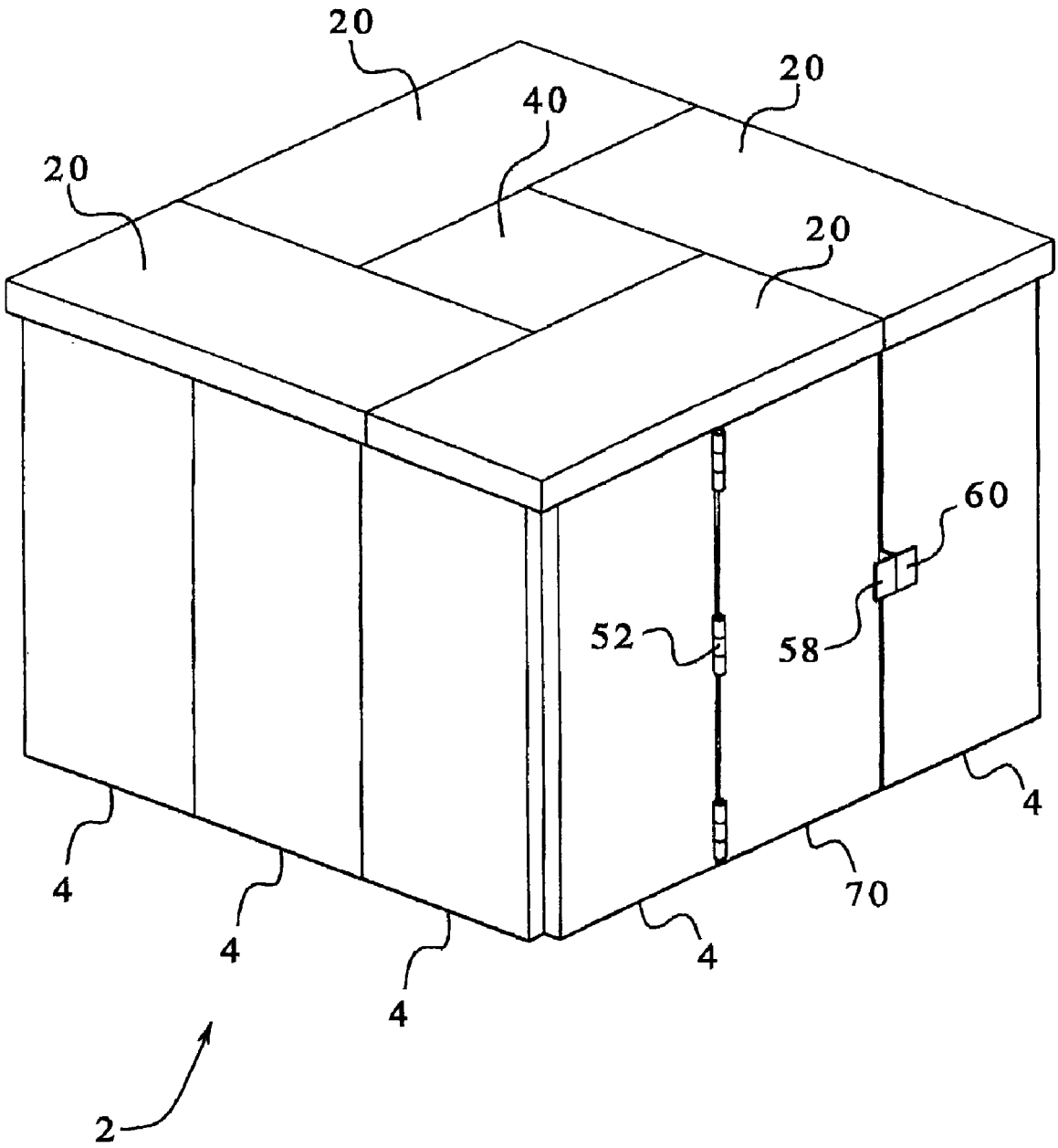
FIG. 7 illustrates a perspective view of a shanty in an embodiment of the present invention.

FIG. 7 illustrates a perspective view of the shanty 2 in an assembled state. To assemble the shanty 2, an individual may position any number of wall panels 4 adjacent to one another to define a room-like shape. For example, the individual may position three wall panels 4 adjacent to each other on each side of the shanty 2, as illustrated in FIG. 1. The individual may also determine a position of the door 70 adjacent to the wall panels 4. The individual may then mount the post 50 and the frame 73 within an interior created by positioning of the wall panels 4. Next, the individual may attach the center roof panel 40 to the frame 73.

The individual may then attach the roof panels 20 to the wall panels 4. To this end, one of the roof panels 20 may be placed at an end of one of the wall panels 4, adjacent to the end 10. The section 34 of the roof panel 20 may be in contact with the section 14 of the wall panel 4. One or more holes 18 of the wall panel 4 may then be aligned with one or more slots 38 of the roof panel 20. A fastener 48 may be inserted between one of the holes 18 and one of the aligned slots 38 to fasten the wall panel 4 to the roof panel 20.

The individual may then align one or more of the slots 46 of the center roof panel 40 with one or more of the slots 38 of the roof panel 20. A fastener 48 may be inserted between the slots 38, 46 to fasten the center roof panel 40 to the roof panel 20. A brace 72 may be attached to one of the wall panels 4 and one of the roof panels 20 at each corner 11 of the shanty 2.

The shanty 2 may provide, for example, a meeting room for workers. The shanty 2 may be used to store personal items. In addition, an overall length or width of the shanty 2 may be defined by adjusting a number of wall panels 4 used to assemble the shanty 2. For example, three wall panels 4 are used on each side of the shanty 2 illustrated in FIG. 1. However, an individual may incorporate any number of the wall panels 4 on a side of the shanty 2 to adapt the shanty 2 to desired dimensions. A requisite number of the roof panels 20 may then be used to attach to the wall panels 4 and to cover and/or enclose the shanty 2. The wall panels 4 and/or the roof panels 20 may be constructed from metal; as a result, the shanty 2 may be fire resistant. Moreover, because the wall panels 4 and the roof panels 20 may be removably fastened, the shanty 2 may be assembled, disassembled and re-assembled using, for example, the same wall panels 4 and/or the roof panels 20 and other components used to assemble the shanty 2. Moreover, when re-assembling, the individual may add/remove the wall panels 4 and/or the roof panels 20 to adjust overall dimensions of the shanty 2.

The holes 18 within the wall panels 4 and/or the slots 38 within the roof panels 20 may enable an individual to fasten, for example, hooks, shelves, or like fixtures within the shanty 2 to provide workers with an area to, for example, store personal items. The shanty 2 may be designed to secure furniture, such as, for example, tables, seats, or like furniture, onto, for example, an inside of the wall panel 4. The furniture may be metal or constructed from the same material as the shanty 2. Likewise, the furniture may be disassembled and re-assembled for subsequent use of the shanty 2.

It should be understood that various changes and modifications to the presently preferred embodiments described herein will be apparent to those skilled in the art. Such changes and modifications may be made without departing from the spirit and scope of the present invention and without diminishing its attendant advantages.

I claim:

1. A shanty comprising:

a plurality of walls that Connect to define a room wherein the plurality of walls Connect to form an interior wherein each of the plurality of walls has a body wherein the body is defined by a length and a width wherein the length is defined between a first end and a second end and the width is defined between a third end and a fourth end wherein a section of each of the plurality of walls at the first end, the second end, the third end, and the fourth end extends a first distance into the interior of the room and further wherein the section of each end further extends a second distance parallel to the length of each of the plurality of walls; and a plurality of roof panels that connect at least one of the plurality of walls to define a ceiling for the room wherein each of the plurality of roof panels has a body defined by a length and a width, wherein the length is defined between a first end and a second end and the width is defined between a third end and a fourth end wherein the body of each of the plurality of roof panels is a single layer and further wherein a section of each of the plurality of roof panels at the first end extends into the interior of the room and further extends parallel to the body of each of the plurality of roof panels and further wherein the section of one of the plurality of walls is attached to the section of one of the plurality of roof panels wherein the plurality of walls and the plurality of roof panels attach to define the room wherein at least one of the roof panels abuts at least one of the wall panels to separate the interior of the room from an exterior of the room and further wherein the single layer of the body of each of the plurality of roof panels separates the interior of the room from the exterior of the room.

2. The shanty of claim 1 further comprising:

a fastener attaching one of the plurality of walls to one of the plurality of roof panels.

3. The shanty of claim 1 wherein the length of one of the plurality of roof panels is equal to twice the width of one of the plurality of walls.

4. The shanty of claim 1 further comprising:

a post attached to one of the plurality of roof panels.

5. The shanty of claim 1 further comprising:

a brace attached to one of the plurality of walls and one of the plurality of roof panels.

6. The shanty of claim 1 further comprising;

a hole formed within the section of the first end of one of the plurality of walls extends into the interior of the room.

7. The shanty of claim 1 further comprising:

a slot formed within the section of the first end of one of the plurality of roof panels extends into the interior of the room.

8. The shanty of claim 1 wherein the plurality of walls are constructed from metal.

9. A system comprising: a plurality of wall panels that abut to define a room wherein the room has an interior defined by the plurality of wall panels and further wherein each of the plurality of wall panels is defined by a body having a length wherein the length is defined between a first end and a second end and further wherein a section of the first end extends a first distance perpendicular to the body of each of the plurality of wall panels and further extends a second distance toward the second end of each of the plurality of wall panels wherein the section extends into the interior of the room;

a roof panel connected to each of the plurality of wall panels at the first end of each of the plurality of wall panels to provide a ceiling to enclose the interior of the room with the plurality of wall panels wherein the roof panel is defined by a body having a length defined between a first end and a second end wherein a section is integrally formed with the roof panel at the first end of the roof panel wherein the section extends perpendicular with respect to the body of the roof panel and within the interior of the room to the first distance and further extends the second distance within the interior of the room and in a direction of the second end of the roof panel; and a fastener attaching one of the plurality of the wall panels to the roof panel wherein the section of the one of the plurality of wall panels extending perpendicular to the body of the one of the plurality of wail panels is attached to the section of the roof panel within the interior of the room and extending toward the second end of the roof panel wherein the section of one of the wall panels abuts the section of the root panel.

10. The system of claim 9 further comprising:

a post attached to the roof panel.

11. The system of claim 9 further comprising:

a hole formed within the section of the one of the plurality of wail panels.

12. The system of claim 9 further comprising:

a slot formed within the section of the roof panel.

13. The system of claim 9 further comprising:

a door positioned adjacent to one of the plurality of wall panels.

14. The system of claim 9 further comprising:

a handle attached to one of the plurality of wall panels.

15. The system of claim 9 further comprising:

a hinge attached to one of the plurality of wall panels.

16. The system of claim 9 further comprising:

a brace attached to one of the plurality of wall panels and the roof panel.

17. A method for assembling a shanty, the method comprising the steps of:

providing a plurality of walls that connect to define a room wherein the room has an interior defined by the plurality of walls wherein each of the plurality of walls has a perimeter defining a first plane between four edges wherein a first portion of each of the plurality of walls at each of the four edges extends into the interior of the room wherein a second portion of each of the four edges extends from the first portion of each of the plurality of walls wherein the second portion defines a second plane perpendicular to the first plane wherein the second portion extends into the interior of the room;

providing a roof panel that connects to each of the plurality of walls to form a ceiling for the room wherein the ceiling with the plurality of walls encloses the interior of the room and further wherein the roof panel has a length defined between a first end and a second end wherein the roof panel has a first section at the first end wherein the first section extends into the interior of the room and further wherein the roof panel has a second section wherein the second section of the roof panel extends within the interior of the room in a direction of the second end; and fastening the first portion of one of the plurality of walls to the second section of the roof panel wherein the first portion of one of the plurality of waits abuts the second portion of the roof panel.

18. The method of claim 17 further comprising the step of:

attaching a post to the roof panel.

19. The method of claim 17 further comprising the step of:

attaching a hinge to one of the plurality of wall panels.

* * * * *

UNITED STATES PATENT AND TRADEMARK OFFICE

CERTIFICATE OF CORRECTION

PATENT NO. : 7,080,489 B2
APPLICATION NO. : 10/612774
DATED : July 25, 2006
INVENTOR(S) : Jedrzejewski It is certified that error appears in the above-identified patent and that said Letters Patent is hereby corrected as shown below:

Column 2 line 49: Change “attached the roof” to --attached to the roof--

Column 3 line 52: Change “along the line B - B of FIG. 3B” to --along the line B - B of FIG. 3A--

Column 6 line 60: Change “Connect” to --connect--

Column 8 line 58: Change “waits” to --walls--

Signed and Sealed this

Sixth Day of March, 2007

JON W. DUDAS
*Director of the United States Patent and Trademark Office*